US005816296A

United States Patent [19]

Schuster

[11] Patent Number: 5,816,296

[45] Date of Patent: Oct. 6, 1998

[54] METHOD AND APPARATUS FOR CONTROLLING THE TENSION AND THE PRESENTATION OF A WEFT THREAD FOR INSERTION INTO A LOOM SHED

[75] Inventor: Rainer Schuster, Lindau, Germany

[73] Assignee: Lindauer Dornier Gesellschaft mbH, Lindau, Germany

[21] Appl. No.: 822,298

[22] Filed: Mar. 21, 1997

[30] Foreign Application Priority Data

Mar. 22, 1996 [DE] Germany ..... 196 11 320.2

[51] Int. Cl.[6] ..... D03D 47/30

[52] U.S. Cl. ..... 139/450; 139/435.1; 139/435.2; 139/435.4; 139/194

[58] Field of Search ..... 139/435.1, 435.4, 139/450, 435.2, 194

[56] References Cited

U.S. PATENT DOCUMENTS

| | | | |
|---|---|---|---|
| 4,501,008 | 2/1985 | Rosseel et al. | 139/194 |
| 5,012,844 | 5/1991 | Griffith | 139/435.1 |
| 5,159,822 | 11/1992 | Schmid et al. | 139/450 |
| 5,226,458 | 7/1993 | Bamelis | 139/194 |
| 5,303,746 | 4/1994 | Wahhoud et al. | 139/435.2 |
| 5,343,898 | 9/1994 | Fredriksson | 139/435.4 |
| 5,423,355 | 6/1995 | Greger et al. | 139/450 |

FOREIGN PATENT DOCUMENTS

| | | | |
|---|---|---|---|
| 0617153 | 9/1994 | European Pat. Off. . | |
| 7022965 | 10/1970 | Germany . | |
| 3603913 | 8/1986 | Germany . | |
| 0179846 | 10/1984 | Japan | 139/194 |

*Primary Examiner*—Andy Falik
*Attorney, Agent, or Firm*—W. F. Fasse; W. G. Fasse

[57] ABSTRACT

The tension of a weft thread in a loom is controlled during particular time phases within the weft supply, weft presentation, weft seizing, and insertion, including the initial phase of entering into the loom shed. Additionally, the weft thread tension may be controlled during the duration of the actual insertion phase when the weft thread travels through the shed. For this purpose a twin nozzle or two separate nozzles are arranged downstream of the weft supply and preferably upstream of a weft brake or weft stop motion. The double nozzle can supply pneumatic impulses in the insertion direction (ID) and/or in the opposite direction (OD). The operation of the double nozzle is controlled by a program that determines the timing and the duration of the pneumatic impulses applied to the weft thread in the insertion direction and/or in the opposite direction. Thus, the twin nozzle is capable of applying a tension for the weft thread during critical phases in the weft supply presentation and insertion for gently handling the weft thread.

10 Claims, 2 Drawing Sheets

METHOD AND APPARATUS FOR CONTROLLING THE TENSION AND THE PRESENTATION OF A WEFT THREAD FOR INSERTION INTO A LOOM SHED

FIELD OF THE INVENTION

The invention relates to controlling the tension of a weft thread as it is being presented to a weft insertion device for insertion into a loom shed, for example by a gripper rod.

BACKGROUND INFORMATION

German Utility Model Publication 7,022,965 (Nickel et al.), published on Oct. 15, 1970, relates to a thread brake for textile machines. The thread brake is capable of influencing the tension of a weft thread as it is being presented for insertion into a loom shed. The known thread brake operates pneumatically rather than mechanically to avoid damage to the threads, especially synthetic weft threads. Such damage can be caused by mechanical weft breaks due to an excessive friction between the thread and the mechanical brake elements. The known pneumatic weft or thread brake comprises an elongated guide tube having a small diameter and a funnel at one end of the tube for facilitating the weft insertion into the guide tube. An air injector is connected to the guide tube near the end opposite the funnel. The air injection takes place in a direction opposite to the insertion direction of the weft thread passing through the guide tube from the funnel end toward the opposite end. The injector or injector pipe is connected through a closure valve with a source of air under pressure. The closure valve is opened and closed in synchronism with the loom operational cycle. High speed looms require a weft thread brake of one kind or another and it is necessary that the brake force applied to the weft thread is controllable either in closed loop or in open loop fashion to assure that the weft thread brakes do not adversely influence the weft threads including synthetic weft threads as they are used in a loom.

German Patent Publication DE 3,603,913 A1 (Taylor), published on Aug. 14, 1986 discloses a pneumatic thread tensioning device. The Taylor disclosure is based on U.S. Ser. No. 06/700,452, filed in the U.S.A. on Feb. 11, 1985. The pneumatic thread tensioning device is positioned between a thread supply and the loom. A thread tension is applied to the weft thread in a direction opposite to the weft withdrawal direction and thus opposite to the insertion direction in a tubular element through which the weft thread is guided. A second tubular element coaxially surrounds the first mentioned tubular element in such a way that a flow passage is formed between the outer wall of the inner element and the inner wall of the outer element to form a flow passage having substantially a ring cross-sectional flow area. Air is introduced into this flow passage in a weft insertion direction corresponding to the thread withdrawal direction from a supply spool. An opening in the wall of the inner tubular element guides the air flow from the ring passage into the inner hollow passage through the inner tubular element, whereby the flow direction of the air stream inside the inner tubular element is reversed to cause the air to flow inside the inner tubular element in the direction opposite to the thread withdrawal direction to thereby apply a certain tension to the weft thread. Due to the use of coaxial tubular elements, the Taylor thread tensioning device is quite expensive. Furthermore, the construction is such that a thread tension can be applied only in a direction opposite to the withdrawal or insertion direction.

European Patent Publication EP 0,617,153 A1 (Greger et al.), published on Sep. 28, 1994 discloses a method and apparatus for influencing the motion of a thread pulled off a supply spool and running to a weft inserter in a weaving loom. The aim of Greger at al. is to provide a gentle guiding of the weft thread prior to its presentation to a weft inserter and to avoid a sudden impact type force on the weft thread as a weft deflection is eliminated. For this purpose an air nozzle is arranged between the supply spool and the weft insertion device. This air nozzle applies an additional acceleration to the weft thread within a determined fraction of the weaving cycle after a weft deflection has been eliminated. This short duration, additional acceleration applied by the air nozzle to the weft thread is intended to assure a gentle guiding of the weft thread and to avoid a so-called stretch impact or stretch mark on the weft thread as it is being presented to the weft inserter. Greger et al. do not provide any suggestions toward the application of a weft tension force prior to and/or during the presentation of the weft thread to the inserter and how to properly tension the weft thread at least at the very beginning of the insertion phase into the loom shed.

Generally, a weft thread presented to the inserter such as a gripper for insertion into the loom shed of a weaving loom, can temporarily lose its tension, for example due to interlocking of several weft threads coming from different supply spools with each other or due to an operator's manipulation during a loom standstill. This loss of tension can take place particularly between a weft thread brake and the fabric edge or selvage. As a result, the probability increases that the weft thread is incorrectly presented to the inserter, whereby the inserter may fail to properly seize the weft thread which in turn will result in an improper insertion or no insertion at all, whereby the loom will be stopped.

OBJECTS OF THE INVENTION

In view of the above it is the aim of the invention to achieve the following objects singly or in combination:

to influence the tension force and thus the weft tension that is applied to a weft thread along its path from a supply spool to the entrance portion of a loom shed, whereby the respective tension force may be directed is in the insertion direction and/or in the opposite direction;

to control the weft tension prior to and/or during the presentation of the weft thread to a weft inserter and also at least during an initial phase of the weft insertion into the entrance end of the loom shed;

to provide an apparatus for performing such a weft tension control that permits applying a tension force in the weft withdrawal direction and/or in the opposite direction toward the supply spool;

to uniformly distribute tension forces effective in a weft thread or a portion of a weft thread particularly just prior to and at the beginning of the weft insertion into the loom shed and if desired also during the actual insertion itself to more gently treat the weft thread; and to help the weft insertion by maintaining a proper weft tension at least during critical phases of the weft insertion thereby to avoid the formation of loops, bends, or deflections in the weft thread.

SUMMARY OF THE INVENTION

The method according to the invention achieves the above objects by the combination of the following steps. As the weft thread is withdrawn from a weft thread supply spool in a weft withdrawing direction which corresponds to the insertion direction of the weft thread into the loom shed, the weft thread is fed at least through a weft stop motion device to a weft presenter which in turn presents the weft thread to a weft inserter. If desired, a weft brake may be arranged upstream of the weft stop motion device as viewed in the insertion direction. As the weft thread is being presented, a pneumatic tensioning force is applied to the weft thread in a direction opposite to the withdrawing direction namely toward the supply spool. Once the inserter has seized the weft thread and begins the insertion into the entrance of the loom shed, a further pneumatic tensioning force is applied to the weft thread in the withdrawing direction namely in the insertion direction at least during an initial phase of the insertion. Once the insertion is completed, the weft thread is beat up, clamped and cut.

The apparatus according to the invention for performing the present method is characterized in that a double acting air nozzle is arranged upstream of a weft stop motion device or upstream of a weft brake if a weft brake is used as viewed in the weft withdrawal direction, whereby the tensioning force applied to the weft thread can be directed in the withdrawal direction and/or in the direction opposite to the withdrawal direction by applying respective pneumatic impulses to the weft thread. The double acting nozzle is either a twin nozzle having one nozzle section directed in the weft insertion direction and another nozzle insertion directed in the opposite direction toward the weft supply spool. Two separate nozzles positioned as described may also be used. However, a twin nozzle is preferred. In both instances the nozzles are positioned between the thread supply mechanism and components positioned downstream of the thread supply mechanism such as the weft brake and/or the weft stop motion device. The air twin nozzles or two nozzles are so controlled that they enhance the weft insertion into the loom shed and also to tighten any weft thread that has become loose along the path between the weft thread withdrawing mechanism and the weft brake, and also in the area of a clamping and cutting shear near the fabric edge or selvage. One of the two nozzles is effective in the withdrawal direction and thus in the insertion direction (ID) while the other is effective in the opposite direction (OD).

According to the present method the weft insertion is supported or enhanced by first activating the nozzle effective in the weft withdrawal direction by applying a respective pneumatic impulse to the weft thread, whereby the weft tension is temporarily reduced because the pneumatic impulse pushes, so to speak, the weft thread in the withdrawal direction so that the pull on the weft thread by the inserter such as a gripper is supported by the push of the pneumatic impulse. Without such a push the weft inserter must apply the entire pulling force to the weft thread for its insertion into the loom shed. On the other hand, the tensioning of the weft thread in the direction opposite to the withdrawal direction is accomplished by activating the respective nozzle or nozzle section. During this time period the weft brake is preferably open, whereby the weft thread is tightened along its length between the weft brake and the selvage, more specifically between the nozzle blowing in the opposite direction (OD) and the selvage.

The method and apparatus of the invention achieve the advantage that the weft thread is kept tight between the clamping shears next to the selvage and the twin nozzle or weft brake at least until the weft thread has been seized by the inserter. Another advantage of the invention is seen in that one of the two nozzles or nozzle sections can pneumatically support or enhance the weft insertion by the inserter, whereby the weft tension is reduced by the push, so to speak, provided by the nozzle pushing in the withdrawal direction, while the other nozzle or nozzle section effective in the opposite direction (OD) pulls weft loops or weft deflections straight. These advantages are important because the probability of a weft thread break during the weft supply and the insertion is thereby greatly reduced.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
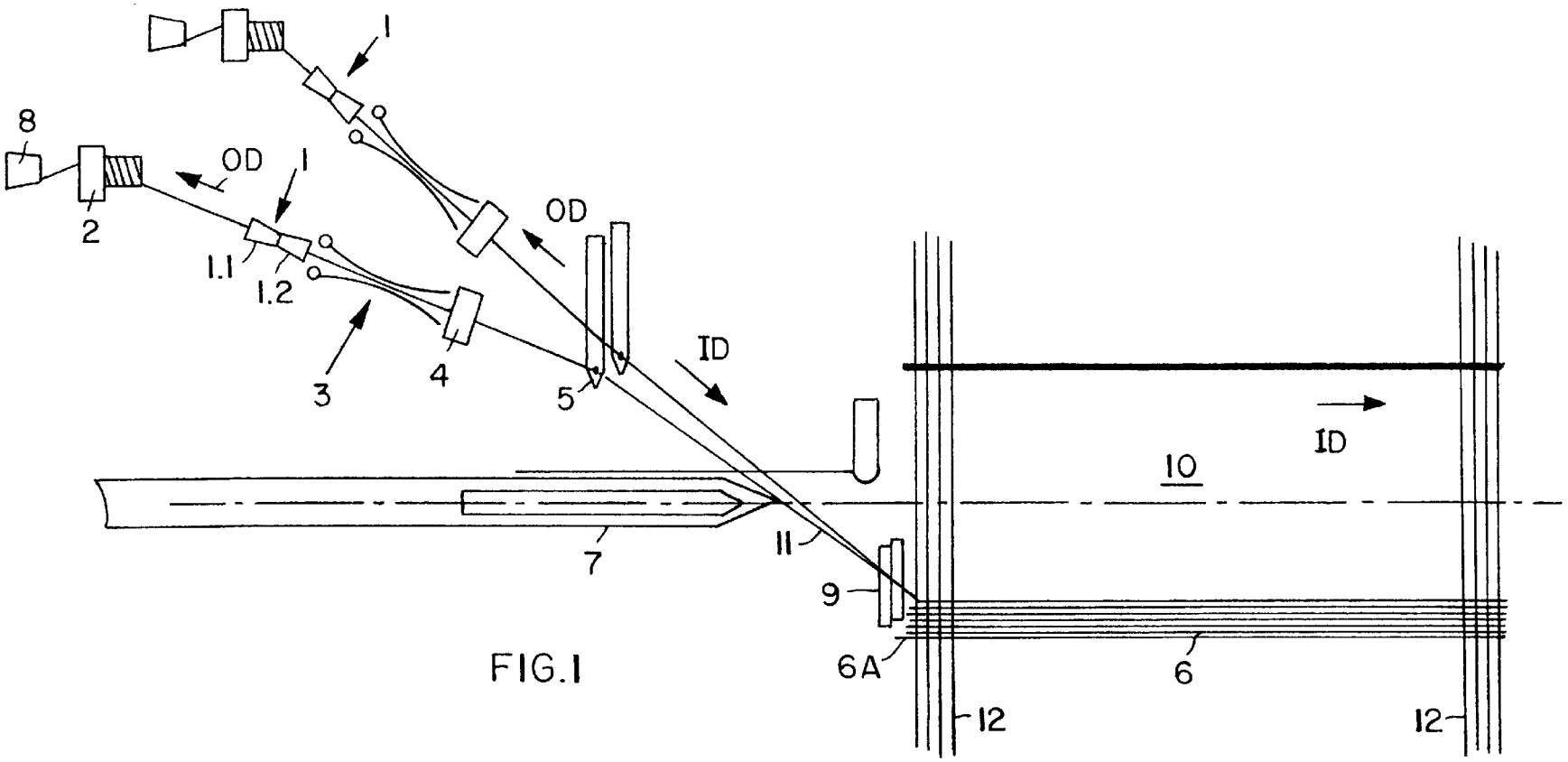
FIG. 1 illustrates the arrangement of a twin air nozzle according to the invention between a weft thread supply mechanism and a weft thread brake.

In FIG. 1 the loom shed 10 is shown in its open condition. A weft inserter, such as a gripper rod 7 with its gripper head, has seized a weft thread 11 and is ready to insert the weft thread into the loom shed to form the fabric 6 in cooperation with the warp threads 12. The weft thread 11 is supplied from a supply spool 8 through a weft withdrawing mechanism 2. The weft 11 travels in the insertion direction ID preferably first through a weft brake 3 followed by a weft stop motion 4 followed by a weft presenter 5 such as a weft presenting needle. However, the use of a weft brake 3 is not necessary according to the invention because the twin nozzle can function as a weft brake if necessary. The weft presenter 5 presents the weft thread 11 prior to its insertion into the loom shed in such a position that the gripper of the inserter 7 can reliably seize the weft thread and insert it into the loom shed 10. A clamping and cutting device, also referred to as a clamping sheet 9, is positioned next to the edge or selvage 6A of the fabric 6. This clamp and cutter combination cuts the tail end of the weft thread 11 after it has been properly inserted into the loom shed 10. Simultaneously, that portion of the weft thread which will become the leading end of the next weft thread is clamped to hold it in a fixed position until the weft thread currently being inserted has been completely inserted.

According to the invention a twin nozzle 1 is positioned between the weft withdrawing device 2 and the inlet of the weft brake 3 or weft stop motion 4 if the weft brake is not used. The twin nozzle comprises two nozzle sections 1.1 and 1.2. The nozzle section 1.1 is oriented to eject its pneumatic impulse in the opposite direction OD to the insertion or withdrawal direction ID. As shown in FIG. 1, the nozzle section 1.2 enhances or supports the motion of the weft thread 11 in the insertion direction ID, while pneumatic impulse of the nozzle section 1.1 is effective in the opposite direction OD to straighten out any weft loops or deflections that may form downstream of the nozzle 1 as viewed in the insertion direction ID.

Following a weft break or prior to the beginning of a weaving operation the weft thread 11 must be passed from the weft withdrawing mechanism 2 through the weft brake 3, the weft stop motion 4, the weft presenter 5, and the insertion member 7, as well as the clamping shear 9. This threading-in operation is advantageously supported by the twin nozzle 1 according to the invention in that the weft thread 11 is first manually fed through the nozzle section 1.1 and then taken over by the nozzle section 1.2 which is switched on to blow the weft thread 11 through the open weft brake 3 and through the weft stop motion 4 whereby the nozzle section 1.2 blows in the insertion direction ID to thereby push the weft in the insertion direction ID. This substantially enhances or facilitates the threading in operation.

During the thread presentation, namely during the phase when the weft 11 is presented by the presenter 5 to the inserter 7, the weft thread may be pulled by an impulse from the nozzle section 1.1 in the opposite direction OD relative to the insertion direction ID. In this connection it is preferable that the weft brake 3 is in an open position at least during the phase when the weft thread 11 is pulled in the opposite direction OD. This phase may have a duration which is a little longer than the presentation phase when the weft 11 is presented by the presenter 5 to the inserter 7. By moving or pulling the weft 11 in the opposite direction OD, it is assured that the weft 11 is kept taut in the important range between the presenter 5 and the clamping shear 9 at the fabric selvage 6A. Keeping the weft taut in this area makes sure that the inserter 7 can reliably and positively seize the weft thread 11 for insertion.

If, for example the nozzle 1.2 is activated during the weft insertion, the weft insertion motion of the weft 11 is supported and facilitated by the pushing of the trailing end of the weft thread in addition to the pulling by the inserter 7. By pulling at the leading end of the weft 11 and pushing at the rear end, the total tension on the weft thread during insertion into the loom shed is reduced. This feature of the invention makes sure that especially where very tension sensitive weft threads are used, one achieves a very gentle treatment of the weft thread during seizing and insertion since the total tension remaining on the weft thread is uniformly distributed along its length.

Figure 2:
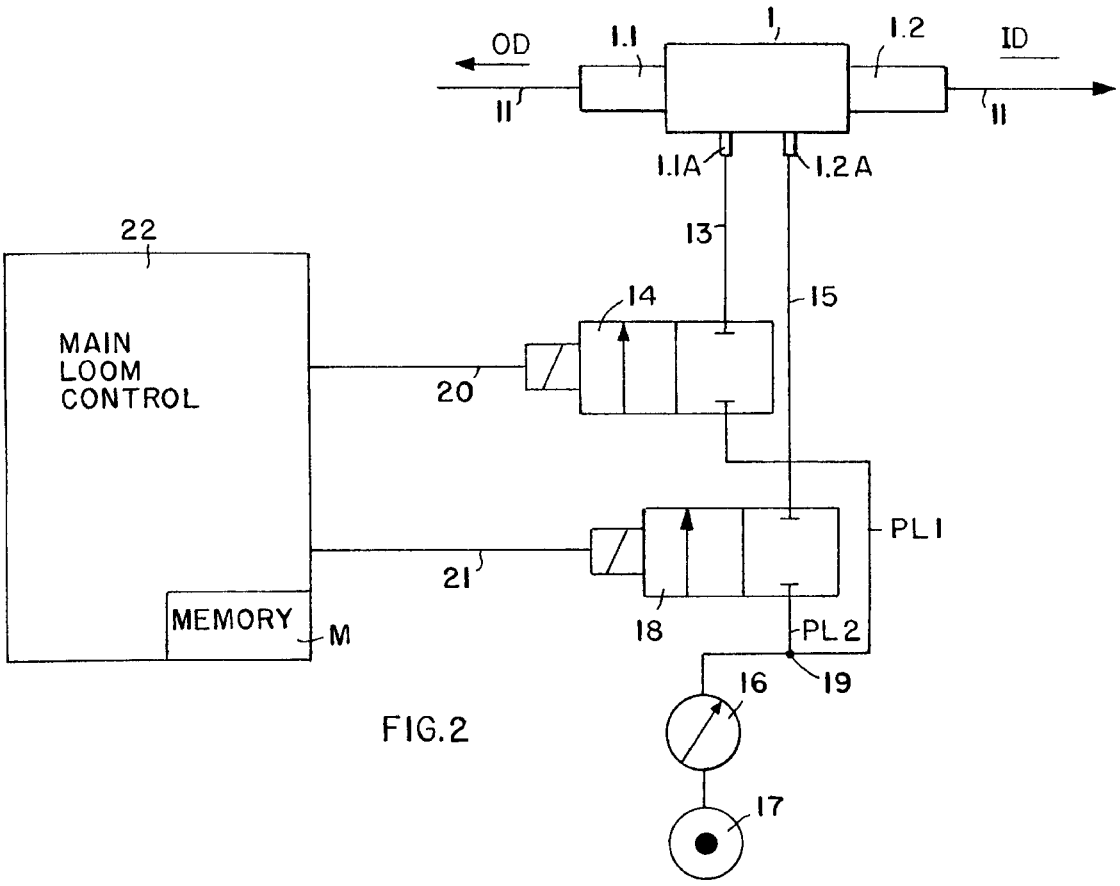
FIG. 2 illustrates a valve control circuit diagram for operating the twin nozzle according to the invention.

FIG. 2 shows the control of the pneumatic impulse application to the weft thread 11 by the twin nozzle 1 having two nozzle sections 1.1 and 1.2 in a common housing for applying tension with the help of pneumatic air blows or impulses in the direction OD and in the direction ID respectively. A pressure fluid inlet port 1.1A of nozzle section 1.1 is connected through a pressure line 13 such as a hose, preferably a flexible hose, to a magnetic valve 14, which in turn is connected through an electrical control conductor 20 to the main loom control 22. Similarly, the valve section 1.2 has a pressure fluid inlet port 1.2A connected through a pressure line or hose 15 to a control valve 18. The control valve 18 in turn is connected through an electrical control conductor 21 to the main loom control 22. Both valves 14 and 18 are connected through pressure supply lines PL1 and PL2 leading through a common junction 19 to a pressure source 17, preferably through a pressure reduction valve 16 inserted between the pressure source 17 and the junction 19.

The operation of the valves 14 and 18 is controlled by a program stored in a memory M in the main loom control 22. The program determines the beginning and the duration of the control of the magnetic valves 14 and 18 for applying the pneumatic impulses in the insertion direction ID and/or in the opposite direction OD. These points of time and durations determine the beginning and the length of time during which impulses are applied prior to the actual weft insertion and/or in the initial insertion phase when the weft thread 11 enters the shed 10. Additionally, the program comprises points of time and time durations for the emission of pneumatic impulses during the weft insertion operation.

The present arrangement of the twin nozzle sections or of separate nozzles according to the invention is primarily intended for use in rapier weaving looms in which the inserter is a first rapier or rod with a gripper head for carrying the weft thread 11 halfway into the loom shed, where a second rapier and gripper head picks up the weft thread and pulls it entirely through the loom shed. However, the present arrangement can also cooperate with pneumatic weft insertion looms.

Another advantage of the invention is seen in that the weft tension can be maintained uniformly along the weft length during the entire weft insertion operation entirely pneumatically so that a mechanical weft break can be avoided altogether depending on the type of thread.

Although the invention has been described with reference to specific example embodiments, it will be appreciated that it is intended to cover all modifications and equivalents within the scope of the appended claims.

What is claimed is:

1. A method for controlling the tension and presentation of a weft thread portion outside the loom shed for insertion into a loom shed, comprising the following steps:

(a) withdrawing said weft thread portion from a weft thread supply spool in a weft withdrawing direction, (b) feeding said weft thread portion through a weft stop motion device and through a weft presenter;

(c) presenting said weft thread by said weft presenter to a weft inserting device for taking over said weft thread;

(d) first pneumatically tensioning said weft thread at least during a time phase or portion of said presenting step in a direction opposite said withdrawing direction, (e) inserting said weft thread into said loom shed by said weft inserting device, (f) second and additionally pneumatically tensioning said weft thread at least during an initial phase of said inserting and presenting steps in said weft withdrawing direction independently of said inserting device, so that during said initial phase the tension is applied in both directions and (g) clamping and cutting said weft thread when the weft thread is fully inserted and beat-up.

2. The method of claim 1, further comprising feeding said weft thread through a weft brake prior to feeding through said weft stop motion device.

3. The method of claim 1, further comprising additionally applying a pneumatic tensioning force to said weft thread at least prior to said presenting step and after said weft inserting device has performed said taking over of said weft thread from said presenter.

4. The method of claim 1, further comprising additionally applying a pneumatic tensioning force to said weft thread at least during an initial phase of said weft thread's entry into said loom shed.

5. The method of claim 2, further comprising opening said weft brake at least for a duration of said first and second pneumatical tensioning steps.

6. An apparatus for controlling the tension and the presentation of a weft thread for insertion into a loom shed, comprising a weft supply mechanism (8, 2), a weft stop motion (4) positioned downstream of said weft supply mechanism (8, 2) as viewed in a weft insertion direction (ID), a weft presenter (5) positioned downstream of said weft stop motion (4), a weft inserter (7) positioned for receiving a weft thread from said weft presenter (5) and arranged for transporting a weft thread leading end into said loom shed, and an air nozzle (1) positioned downstream of said weft supply mechanism (8, 2) and upstream of said weft stop motion (4) for applying pneumatic impulses to said weft thread (11) in said weft insertion direction (ID) and additionally in an opposite direction (OD) at least during an initial phase of a weft insertion to control the tension of a portion of said weft thread outside said loom shed independently of said weft inserter.

7. The apparatus of claim 6, further comprising a weft brake (3) positioned between said air nozzle (1) and said weft stop motion (4).

8. The apparatus of claim 6, wherein said nozzle (1) is a twin nozzle comprising a first section (1.1) facing in said opposite direction and a second section (1.2) facing in said insertion direction for emitting pneumatic impulses that influence a tension of said weft thread (11) in said opposite direction (OD) and in said insertion direction (ID), respectively.

9. The apparatus of claim 8, further comprising a source (17) of pneumatic pressure, a controllable valve device (14, 18) connecting said twin nozzle (1) to said source (17) of pneumatic pressure, a loom control (22), and electrical control conductors (20, 21) connecting said valve device to said loom control for controlling the supply of pressurized air to said twin nozzle (1).

10. The apparatus of claim 9, wherein said twin nozzle (1) comprises a common housing, a first nozzle section (1.1) having a first pressure inlet (1.1A), and a second nozzle section (1.2) having a second pressure inlet (1.2A) in said common housing, said controllable valve device comprising a first valve (14) connected to said first pressure inlet (1.1A) and a second valve (18) connected to said second pressure inlet, and wherein both valves are connected in common at (19) to said source of pneumatic pressure.

* * * * *

UNITED STATES PATENT AND TRADEMARK OFFICE

CERTIFICATE OF CORRECTION

PATENT NO. : 5,816,296

DATED : Oct. 6, 1998

INVENTOR(S) : Schuster

It is certified that error appears in the above-identified patent and that said Letters Patent is hereby corrected as shown below:

On the Title Page:

In [54] replace title to read: --WEFT TENSION CONTROL FOR A WEAVING LOOM--.

In [56] References Cited, under FOREIGN PATENT DOCUMENTS, line 4, replace "0179846" by --59-79846--.

Col. 1, lines 1 to 4, replace the title to read: --WEFT TENSION CONTROL FOR A WEAVING LOOM--.

Signed and Sealed this

Sixteenth Day of February, 1999

*Attest:*

*Attesting Officer*

*Acting Commissioner of Patents and Trademarks*